US011136216B2

(12) United States Patent
Honl

(10) Patent No.: US 11,136,216 B2
(45) Date of Patent: Oct. 5, 2021

(54) HANDHELD PORTABLE POWER HOSE ROLLER

(71) Applicant: Anthony Ryan Honl, North Bend, OR (US)

(72) Inventor: Anthony Ryan Honl, North Bend, OR (US)

( * ) Notice: Subject to any disclaimer, the term of this patent is extended or adjusted under 35 U.S.C. 154(b) by 159 days.

(21) Appl. No.: 16/670,728

(22) Filed: Oct. 31, 2019

(65) Prior Publication Data

US 2020/0262676 A1 Aug. 20, 2020

Related U.S. Application Data

(60) Provisional application No. 62/806,668, filed on Feb. 15, 2019.

(51) Int. Cl.

| | |
|---|---|
| ***B65H 75/12*** | (2006.01) |
| ***B65H 75/44*** | (2006.01) |
| ***B65H 75/40*** | (2006.01) |

(52) U.S. Cl.

CPC ..... *B65H 75/4486* (2013.01); *B65H 75/12* (2013.01); *B65H 75/406* (2013.01); *B65H 75/4489* (2013.01); *B65H 2402/412* (2013.01); *B65H 2403/10* (2013.01); *B65H 2701/33* (2013.01)

(58) Field of Classification Search

CPC .. B65H 75/12; B65H 75/406; B65H 75/4486; B65H 75/4489; B65H 2402/412; B65H 2403/10; B65H 2701/33

See application file for complete search history.

(56) References Cited

U.S. PATENT DOCUMENTS

| | | | | | |
|---|---|---|---|---|---|
| 4,198,010 | A * | 4/1980 | Knapp | A62C 33/04 | 242/403.1 |
| 4,280,672 | A * | 7/1981 | Santos | B65H 54/585 | 242/534.2 |
| 5,566,901 | A * | 10/1996 | Wilder | A62C 33/02 | 242/395 |
| 6,027,066 | A * | 2/2000 | Street | B65H 18/02 | 112/7 |

* cited by examiner

*Primary Examiner* — Sang K Kim

(57) ABSTRACT

A portable hose winding machine includes a power head including a motor in a motor housing, with the motor having an output shaft and a bar coupled to the motor housing. The bar further includes an aperture or other fixtures such as a fairlead through which a hose is guided while being spooled up on a driven shaft.

Spooling is driven by a rod axially parallel to and radially spaced apart from a driven spool shaft, and a protective plate shields the user's hands from errant spinning hose end fixtures.

15 Claims, 6 Drawing Sheets

HANDHELD PORTABLE POWER HOSE ROLLER

CROSS REFERENCE TO RELATED APPLICATION

This non-provisional utility patent application claims the benefit of and priority to U.S. Provisional Patent Application 62/806,668 "Handheld Portable Power Hose Roller," filed 15 Feb. 2019. The entire contents of U.S. Provisional Patent Application 62/806,668 "Handheld Portable Power Hose Roller," filed 15 Feb. 2019, are hereby incorporated into this document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to motorized spooling machines typically used for taking up lengths of hose lying around on the ground, or for winding cargo straps.

BACKGROUND

Hoses for water delivery, especially for fire suppression in unimproved areas such as forests, require the deployment and retrieval of hundreds, thousands, or millions of feet of fire hose to form hose lays up and down roads, bulldozer lines, steep hillsides, and across drainages and wherever water is needed to fight or control fire. When the hose is no longer needed for these activities, the hose must be recovered and transported from the field, which usually includes topography, natural obstacles such as trees or brush, terrain features such as rocks, logs, or bodies of water, and other factors which impede access and movement.

Common methods for recovering fire hose from the field include but are not limited to manually pulling and piling the fire hose, manually rolling the fire hose, and use of equipment or machines. Most existing machines are not readily transportable in forests or mountainous areas, meaning that onerous physical tasks are required for either working the hose without use of a convenient, portable machine, or the tasks of bringing along currently available machines which are often bulky and inconvenient to use or transport.

Methods mentioned above for recovering fire hose often still leave unorganized piles of fire hose, sloppy fire hose rolls, and bulky bundles of fire hose that limit the amount that can be carried and which are difficult and potentially hazardous to transport through terrain.

BRIEF DESCRIPTION

A primary objective of the invention is to offer a device useful in the recovery of fire hose after field use in challenging terrain that may retrieve and tightly roll fire hose efficiently for safe and convenient means of transporting hoses out of the area of operations.

Another objective of the invention is to provide a device which may be operated entirely while being carried by the user, with no contact with the ground being necessary to position, orient, or stabilize the device.

Yet another objective of the invention is that it be portable and convenient to deploy in forest fire fighting environments or similar environments or operations involving retrieval of hoses, straps, or similar materials, where speed and ease of use are desirable. For example, in a military operation delivering strapped-down containers or equipment by aerial transport into or near an active combat area, the invention provides rapid and portable means of retrieving disconnected straps so that the delivery vehicle may evacuate to safety as quickly as possible. Thus a corollary objective of the invention is that it be physically rugged and able to operate after being dropped or tumbled to the ground in its environment of use.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

Figure 1:
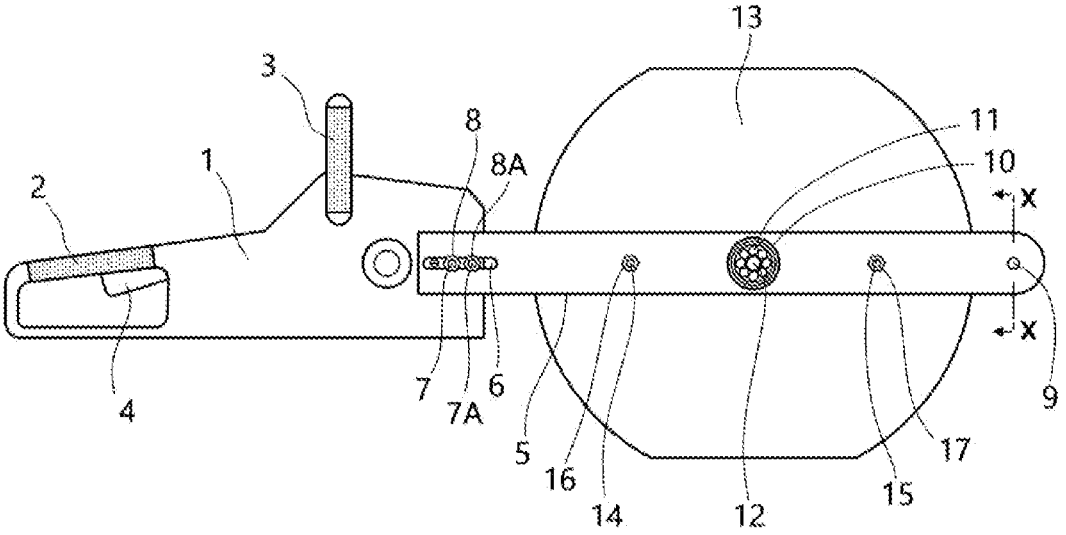
FIG. 1 shows a side view of an embodiment of a hand held portable power hose roller in accordance with the invention, including a power head, a frame work, a plate, and an inner bearing.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The words and terms "roll," "rolls," "rolling," "rolling up" "spool" and "spooling" and similar phrases used herein are to be understood to mean same as but not limited to, taking up, recover or recovering, wind or winding, coil or coiling of a hose, straps, cords, or other long objects amenable to coiled storage and transport. In this specification the phrase "substantially perpendicular" means an alignment of a first feature with respect to a second feature to within 15° of a theoretical perpendicular alignment.

The phrase "operably coupled" such as when used as "[A] is operably coupled to [B]" means that when [A] is operated then [B] is caused to operate. The operation of [B] in response to [A] may incorporate but not be limited to a direct relation, a proportional relation, or an inverse relation, and time delays may be designed in between the actuation of device or controller [A] and the behavior of [B.] The phrase "[A] is operably coupled to [C] by means of [B]" means that [A] is operably coupled to [B] and [B] is operably coupled to [C,] so that the intermediate component or system [B] may act as a modulating influence on the operation of component or system [C] in response to actuations of device or controller [A.] The operation of [C] in response to [A] may incorporate but not be limited to a direct relation, a proportional relation, or an inverse relation. Time delays may be incorporated between [A] and [B] or between [B] and [C] or both between [A] and [B] and between [B] and [C.]

Unless otherwise defined, the term "field" used herein describes any place where hoses or straps or the like may be used, such as but not limited to forest land, range land, tree farms, and urban environments.

The invention relates to a hand held portable powered device, apparatus, or tool that rolls up material. More particularly, the invention relates to rolling up fire hose for recovery from the field, and storage and transporting, and the like. Alternate embodiments of the invention may include but are not limited to being an attachment to an existing power head or an existing hose end attachment, but also may be the in form of a stand-alone device rather than an attachment or a hose accessory.

The invention includes a motor or motive power source which may be a petroleum fuel engine, an electric motor, or a hydraulic or pneumatically driven motor which provides rotational driving force for the rest of the apparatus. The motor may be but is not limited to an internal combustion engine, including 2-stroke, 4-stroke, or radial, or may be an electric DC or AC motor or also an external rotor motor.

The invention includes a power transmission to transmit rotational driving force from the motor output shaft to a spool which is used to accumulate hose, so that the motor is operably coupled to the spool shaft through the power transmission. The power transmission may comprise various drive train components such as sprockets and drive chains, or gears which may be involute toothed gears, bevel gears or helical gears, or the power transmission may be a shaft drive assembly whereby the motor output shaft drives a worm gear and reduction wheel or gear trains for changing the axis of rotation while transferring rotary power from the motor output shaft to the spool shaft. Such gear trains may include bevel gears, hypoid gears, a pinion gear and ring wheel, or helical gears.

In this specification the word "hose" will also imply and connote that the invention may also be utilized for spooling up any sorts of long, slender, flexible items including cargo straps, ribbon cables, or strip materials such as caution tape or audio tape, punched paper or mylar tapes, or movie film. A power transmission in this specification may comprise various drive train components, such as but not limited to chain drive, belt drive, shaft drive, or a gear drive, or any other mechanism operably coupling rotary output motion of the motor to the driven rotary motion of the spool. The operable coupling from the motor to the spool may be a direct or 1:1 drive, or it may have a turn-down ratio so that the spool is driven slower than the motor output shaft but at higher torque, such as an embodiment wherein the operable coupling includes a gear box. Other operable couplings include variable ratio power transmissions or non-linear relationships between motor output and rotation of the hose stake-up spool.

The invention also includes an infeed guide operating on the hose, strap, or tape being spooled up by the invention. The guide provides alignment of and tension for the material being reeled in.

Referring to FIG. 1, a power head [1] houses a motor which provides torque. The power head may comprise one or more handles [2, 3,] and a control trigger or on/off switch [4] operably coupled to the motor, or the trigger may be operably coupled to the motor through means for variable control over the output torque of the motor such as by a potentiometer, rheostat, a fuel feed rate controller, a linear variable differential transformer or other controllers for a variable speed drive.

The frame work comprises a bar [5] or beam extending from the power head in a longitudinal direction. The bar may also be called a flat bar, and it further comprises a longitudinal slot [6] adapted to fit over mounting studs [7] and [7A,] which together with nuts [8] and [8A,] provide means for fastening the flat bar to the power head. The bar may also be configured as a tube or a section of formed or rolled channel. An aperture [9] at a distal end of the flat bar from the longitudinal slot provides a fastening point for a guide, which neatly aligns incoming hose onto a spool. The guide is omitted in this view but is shown and discussed in FIG. 5. Between the ends of and near the center of the flat bar is a bearing housing [10] which houses an inner bearing [11] through which a spool shaft [12] extends. The bearings may be ball or needle bearings, or in an alternate embodiment, item [11] is a bushing selected from a material effective for retaining rotating components, such as oil impregnated bronze, plastic resins which include Teflon, or acetal, which is a plastic also called polyoxymethylene (POM) or Delrin®. POM is a preferred material for many sorts of rotational components.

A backing plate [13] is attached to the flat bar to provide a laterally stabilizing surface for the fire hose as it is accumulating within the spool.

Studs [14] and [15] are fastened to the flat bar [5] by means of nuts [16] and [17] and the studs extend perpendicular to the flat bar and away from the backing plate. These studs provide fastening means for affixing the outer rotational shaft bearing frame shown and described in FIG. 2.

Figure 2:
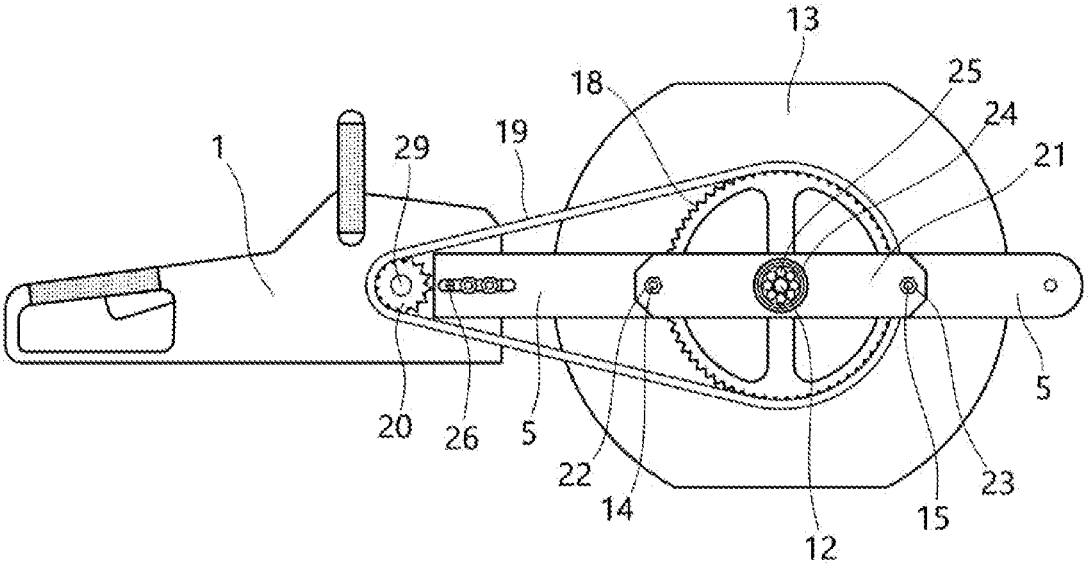
FIG. 2 shows another side view of an embodiment of a hand held portable power hose roller in accordance with the invention, including a drive sprocket, a driven sprocket, a roller chain, an outer bearing assembly, and an adjustment screw.

FIG. 2 shows another side view of an embodiment of a hand held portable power hose roller in accordance with the invention, including a drive sprocket, driven sprocket, a roller chain, outer bearing assembly, and an adjustment screw. Drive sprocket [20] transmits the torque supplied by the output shaft [29] of the motor housed in the power head by converting torque into tension within the linked elements of a roller chain [19,] which in driven sprocket [18] is converted back to torque for rotating the take up spool and for supplying tension in the hose while it is being accumulated. The driven sprocket is attached to the spool shaft [12.]

An outer rotational shaft bearing frame [21] is attached to studs [14] and [15] by means of nuts [22] and [23.] A bearing housing [24] is attached to the outer rotational shaft bearing frame, and the bearing housing houses an outer bearing [25] for supporting the spool shaft which extends into it and may also pass through the bearings, depending on the design of the bearings selected for this assembly.

An adjustment screw [26] provides means to adjust tension of the roller chain [19] by extending the flat bar longitudinally so that the drive sprocket and driven sprocket may be extended apart longitudinally or be drawn closer to each other.

Figure 3:
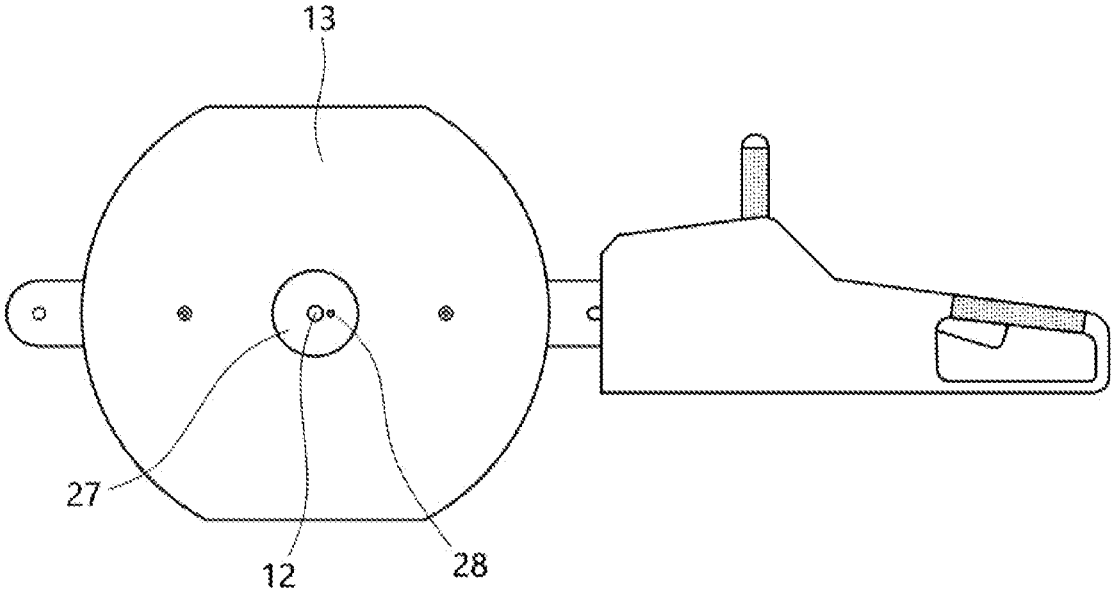
FIG. 3 shows an opposite side view of the embodiment of a hand held portable power hose roller shown in FIG. 2, including a rotational shaft, a disc, and a rod as some of its components.

FIG. 3 shows an opposite side view of the embodiment of a hand held portable power hose roller shown in FIG. 2, including a rotational shaft, a disc, and a rod as some of its components. The spool shaft [12] and parallel rod [28] both extend perpendicularly from the backing plate [13] and provide means for temporarily and removably attaching a hose or a strap, which means in this embodiment is the gap between the spool shaft and the rod, wherein the gap is larger than a collapsed cross section of hose or strap being accumulated, and smaller than a rigid end fitting of the hose such as a threaded coupler, or a thickened hem made at a strap end by a knot, or by stitching through a rolled or folded over strap end comprising two or more thicknesses of strap material.

A spool end wall disc [27] is also attached to the spool shaft and is parallel to and preferably flush or nearly flush with the backing plate. The rod and the spool shaft are also both attached to the spool end wall disc.

Figure 4:
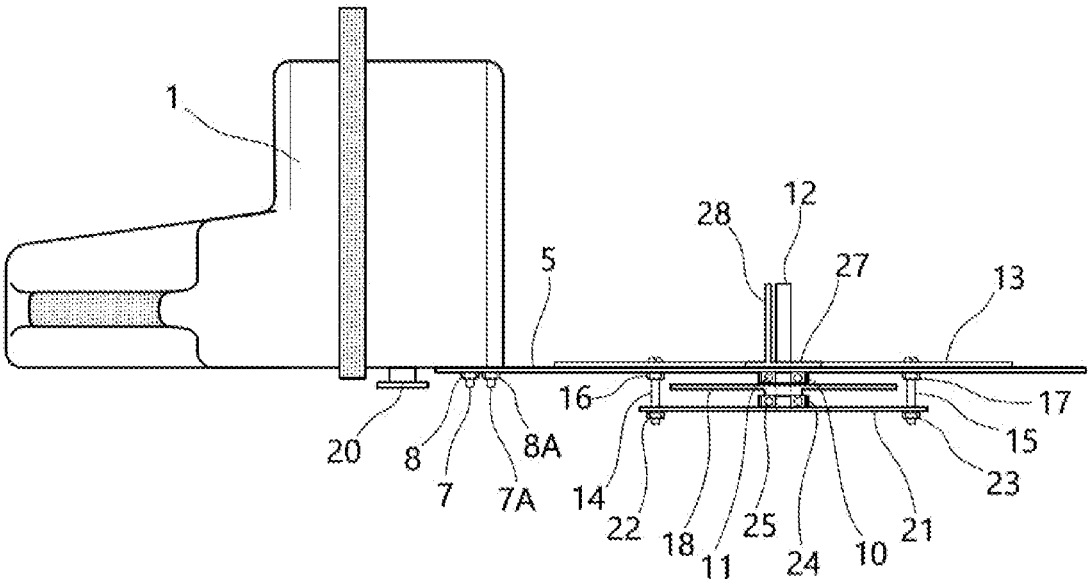
FIG. 4 shows a top view of an embodiment of a hand held portable power hose roller in accordance with the invention, including the power head, a drive sprocket, a driven sprocket, a frame work, a rotational shaft, an inner bearing assembly, an outer bearing assembly, a backing plate, a disc, and rod components.

FIG. 4 shows a top view of an embodiment of a hand held portable power hose roller in accordance with the invention, including the power head, drive sprocket, driven sprocket, frame work, rotational shaft, inner bearing assembly, outer bearing assembly, backing plate, disc, and rod components.

Rotatable spool shaft [12] extends through inner bearing housing [10] which houses inner bearing [11,] and is coupled to driven sprocket [18] which may fixed to the spool shaft by means such as a key way and set screw or a split hub and set screw, or a keyless locking bushing such as one of the Trantorque® design. An outer bearing housing [24] which is attached to an outer rotational shaft bearing frame [21] houses an outer bearing [25] through which the spool shaft also extends.

Studs [14] and [15] are fastened to flat bar [5] by means of nuts [16] and [17,] and extend perpendicular to the flat bar and away from backing plate [13.] The outer rotational shaft bearing frame is also attached to studs [14] and [15] by means of nuts [22] and [23.] The rod [28] is aligned axially parallel to and radially spaced apart from the spool shaft, and the spool shaft and rod are also attached to spool end wall disc [27.]

The flat bar is attached to a power head [1] by means of mounting studs [7] and [7A,] which together with nuts [8] and [8A,] comprise an embodiment of means for fastening the flat bar to the power head. Lastly in this figure, the drive sprocket [20] converts motor torque into tension applied through the drive roller chain [19] of FIG. 2] omitted here for clarity of other parts shown.

Figure 5:
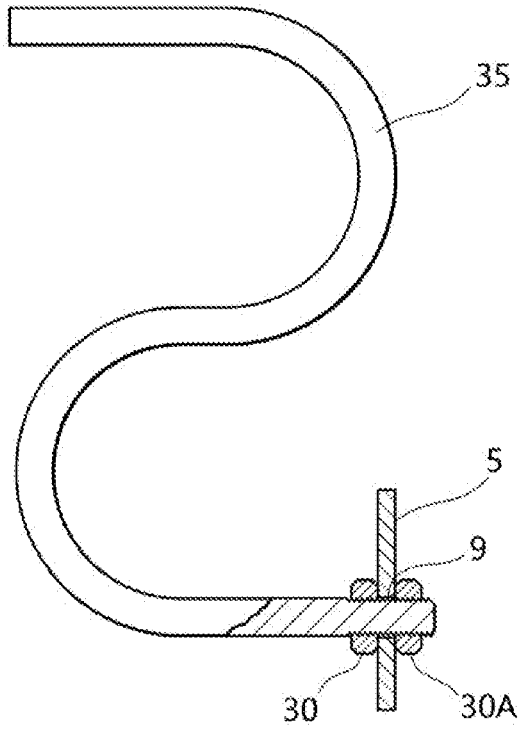
FIG. 5 shows a cross section of a portion of the flat bar of the invention taken at line x-x as shown in FIG. 1.

FIG. 5 shows a cross section of a portion of the flat bar of the invention taken at line x-x as shown in FIG. 1. The guide [35] is affixed to a distal end of the flat bar [5] through aperture [9] by means of nuts [30] and [30A] which provide for tension and alignment of incoming fire hose as it is accumulated onto the spool. The location of aperture [9] along the flat bar is shown in FIG. 1. The guide may be adjustably oriented within a range of positions to increase or decrease tension of incoming fire hose. Although this embodiment of a guide is a serpentine shape, other shapes are effective as a tension modulating guide for incoming fire hose as it is accumulated onto the spool.

A cover, guard, or grille contemplated within the scope of the invention closely follows the contours and swept volumes of the drive sprocket, roller chain, and driven sprocket preferably in accordance with drive belt guard safety standards such as OSHA standards for general guarding of machinery and mechanical power transmission apparatus (29 CFR 1910.212 and 1910.219.) The belt guard attaches to studs [14] and [15] seen in FIG. 1 or FIG. 2.

FIG. *6a* shows an oblique view of an alternative embodiment of a hand held portable power hose roller in accordance with the invention. The power head [1] includes one or more handles [2, 3,] and an internal motive power source such as a motor or engine with a rotary output shaft [29] operably coupled to power transmission elements such as a drive sprocket [20] driving a chain [19] connected to a driven sprocket [18] mounted partway along a bar [5.] The bar may be affixed to the power head by fasteners as seen in FIGS. 1 and 2, or it may be permanently attached to the power head such as by a weldment.

A backing plate [13] is attached to the flat bar to provide a laterally stabilizing surface for the hose as it is accumulating by the spool shaft. Studs [14] and [15] affix an outer rotational shaft bearing frame [21] to the flat bar by means of nuts [22] and [23.]

The distal end of the bar includes a hose guide which in this embodiment comprises two fairleads [32,] which are rods positioned transverse to the movement direction of incoming hose being wound upon the spool shaft. The incoming hose passes between the two fairleads and between the flat bar and a fairlead side plate [33.] Fairleads help stabilize incoming uncontrolled bights, loops, or waves of hose, strap, or rope being wound, so that the coiled pitch of what is being wound may become dense and uniform. In the embodiment shown, the fairleads are threaded tubes which receive bolts [31] into their ends so that these bolts may anchor them to the bar. In an alternative embodiment in accordance with the invention, the fairleads include rotatable bearing surfaces such as tubes to reduce friction of the incoming hose or strap. The distal end of the bar may further comprise a plurality or an array of holes so that the hose guide may be adjustably affixed to the distal end of the bar.

Figure 6A:
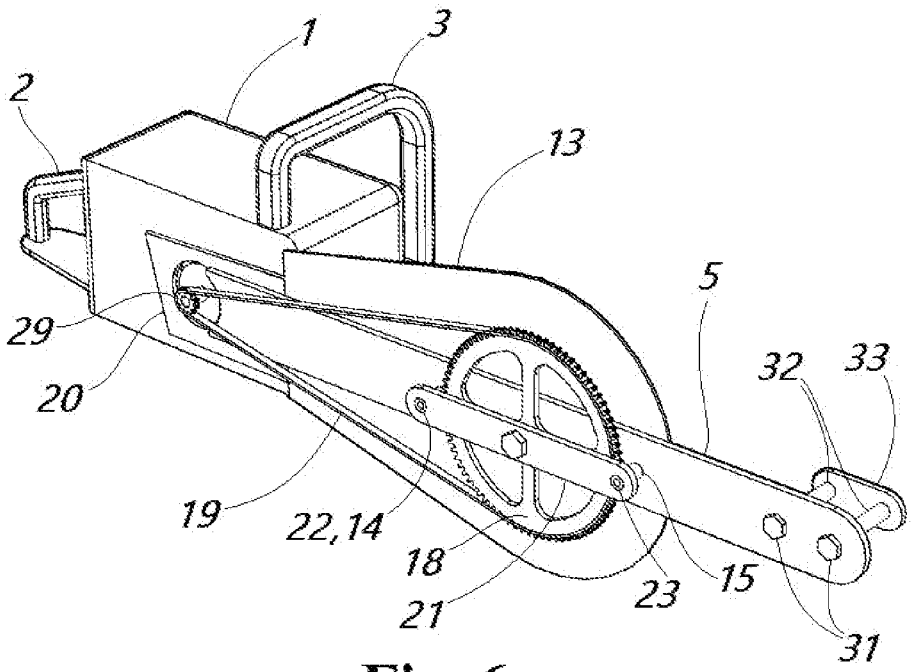
FIG. 6*a* shows an oblique view of an alternative embodiment of a hand held portable power hose roller in accordance with the invention.
Figure 6B:
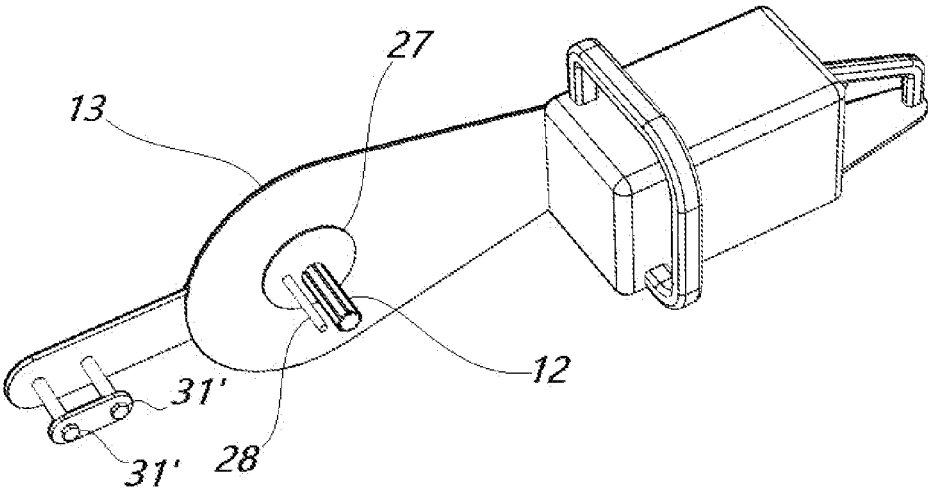
FIG. 6*b* shows another oblique view of the embodiment of the hand held portable power hose roller shown in FIG. 6*a*.

FIG. 6*b* shows another oblique view of the embodiment of the hand held portable power hose roller shown in FIG. 6*a*. In this view the other two fairlead bolts [31'] are seen and the spool shaft [12] extends through the backing plate [13] and is operably coupled to the power transmission. A parallel rod [28] is parallel to the spool shaft and both extend perpendicularly from the backing plate to provides means for temporarily and removably attaching a hose or a strap, which means in this embodiment is the gap between the spool shaft and the parallel rod. A spool end wall disc [27] is also attached to the spool shaft for rotation with the spool, and the disc is parallel to and preferably flush or nearly flush with the backing plate. The parallel rod and the spool shaft are also both attached to the spool end wall disc, and the rod orbits around the spool shaft by rotating about the rotational axis of the spool shaft. According to an alternative embodiment, the spool end wall disc may be affixed to the bar to provide a laterally stabilizing surface for hose accumulated upon said spool shaft but without necessarily rotating with the spool shaft.

Figure 7A:
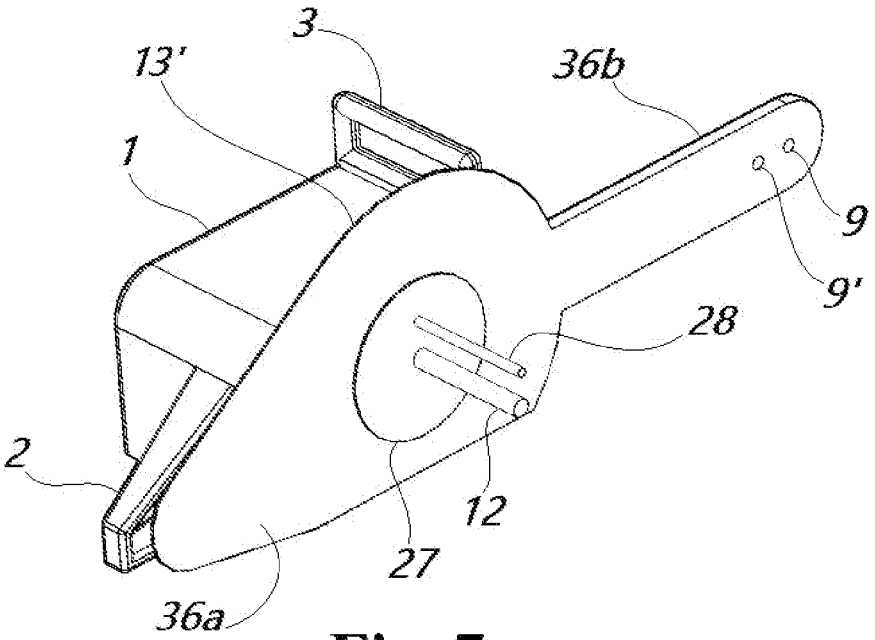
FIG. 7*a* shows another alternative embodiment of a hand held portable power hose roller in accordance with the invention.

FIG. 7*a* shows another alternative embodiment of a hand held portable power hose roller in accordance with the invention. The power head [1] includes one or more handles [2, 3,] and an internal motive power source such as a motor or engine, with a rotary output shaft comprising the spool shaft [12,] and with a parallel rod [28] also extending axially parallel to and radially spaced apart from the spool shaft. The rod orbits around the axis of the spool shaft.

A backing plate [13'] attaches to a side of the power head. The backing plate includes a guard section [36*a*] and a bar section [36*b*.] The guard section protects the user's hands which, while grabbing the handles and operating handle mounted controls such as an engine throttle, may end up uncomfortably close to a spinning hose end fixture or a bight of hose being spooled up. The guard section protects against a user's fingers or hand getting struck by hose end fixtures which may spiral into place as the end of the hose is spooled up, and the guard also protects against pinching hazards and protects against a user's hand being caught and drawn into a motor-driven hose spooling process where injury might occur.

Figure 7B:
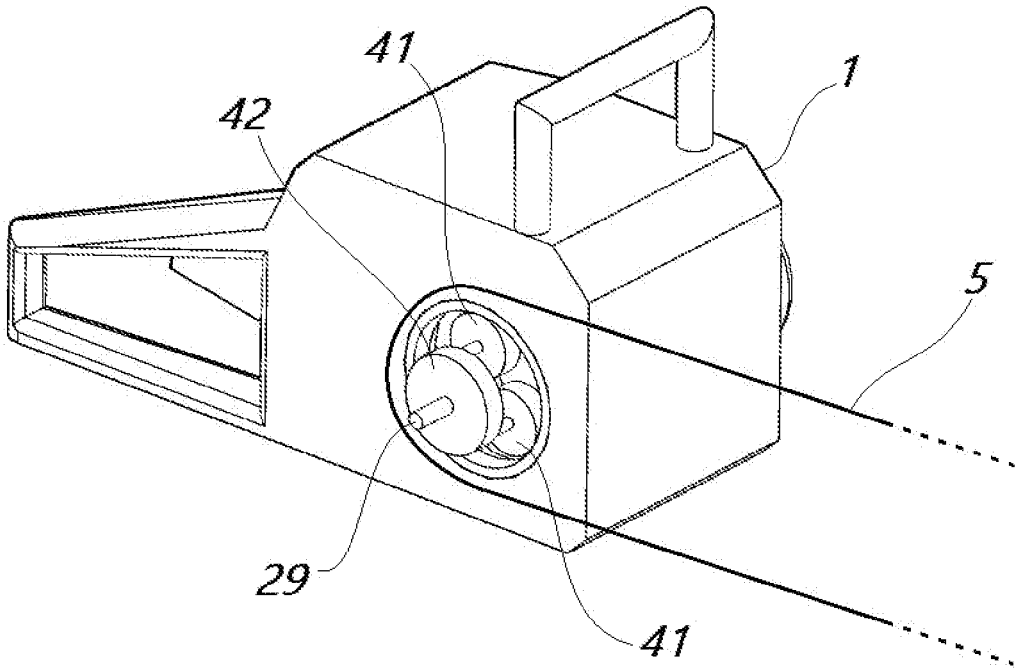
FIG. 7*b* shows another alternative embodiment of a hand held portable power hose roller in accordance with the invention, including epicyclic or planetary reduction gearing.

FIG. 7*b* shows another alternative embodiment of a hand held portable power hose roller in accordance with the invention, including epicyclic or planetary reduction gearing. The bar [5] is attached to the power head [1] and is shown extending to broken lines as it may be configured according to any of the several embodiments described herein. The motor or engine inside the power head has a drive shaft with a sun gear engaged to a plurality of planetary gears [41] whose center shafts are affixed to a differential arm [42,] and the rotational output of the differential arm drives the output shaft [29] of the epicyclic or planetary system.

Figure 7C:
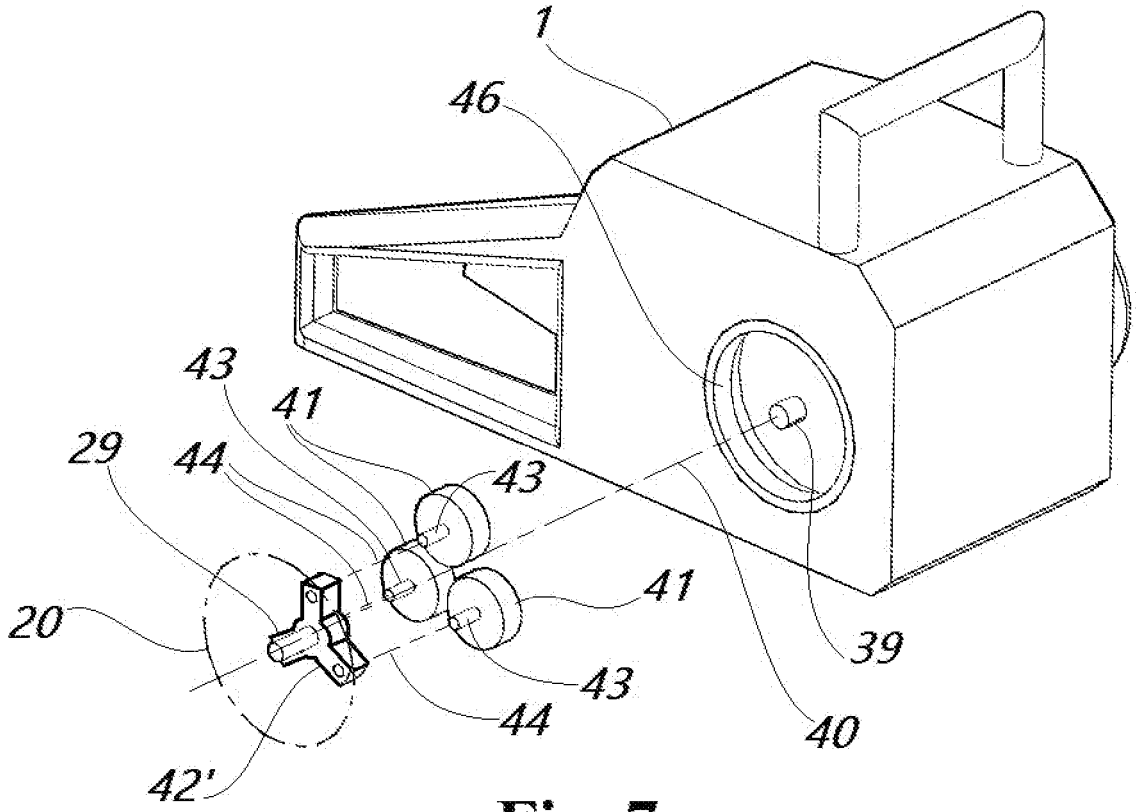
FIG. 7*c* shows the alternative embodiment of the hand held portable power hose roller of FIG. 7*b*, with the set of planetary gears shown exploded.

FIG. 7*c* shows the alternative embodiment of the hand held portable power hose roller of FIG. 7*b*, with the set of planetary gears shown exploded. The motor or engine inside the power head [1] has a drive shaft with a sun gear [39] that contacts complementary teeth of a plurality of planetary gears [41.] According to one set of embodiments, the planetary gears are coupled to shafts [43] which are received in bearings or bushings mounted in a differential arm [42',] or alternatively the bearings or bushings may comprised within the hubs of the planetary gears, and these ride on shaft stubs pressed into the differential arm. The teeth of the planetary gears also engage with internal teeth of a ring gear [46] so that as the axes of rotation [44] of the planetary gears precess within the ring gear, the differential arm rotates on the same axis [40] as the drive shaft, but at a much reduced speed and with increased torque available. The differential arm comprises an output shaft [29] for coupling to a drive sprocket [20] or sheave or output gear shown as a dash-dot phantom line.

Figure 7D:
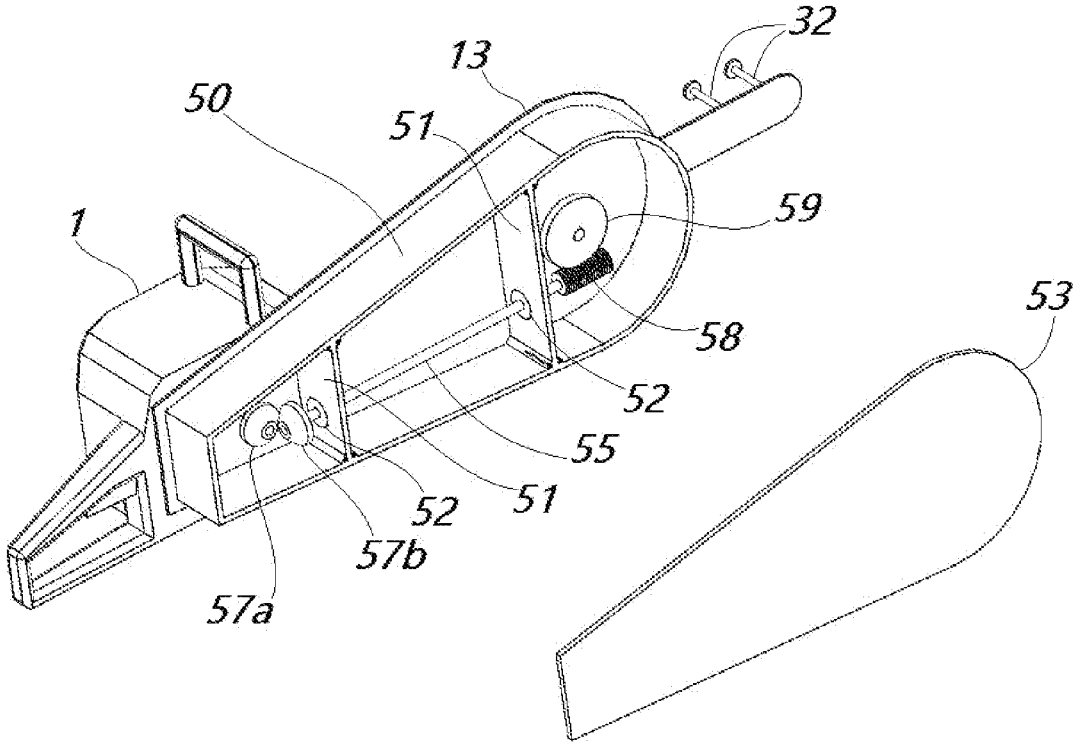
FIG. 7*d* shows a shaft-drive embodiment of a hand held portable power hose roller in accordance with the invention, including bevel gears and a worm and wheel reduction gear set.

FIG. 7*d* shows a shaft-drive embodiment of a hand held portable power hose roller in accordance with the invention, including bevel gears and a worm and wheel reduction gear set. A power train case includes a backing plate [13] which attaches to the power head [1] and which also includes a perimeter wall [50] and a removable cover plate [53] having a perimeter conforming to that of the perimeter wall of the case. Glands or gaskets may also be included at the closure of the cover plate to the perimeter wall of the case to retain lubricants for the power train components inside the case and to exclude foreign matter.

Ribs [51] within the case may preferably be transverse ribs and these hold bearings or bushings [52] for supporting a drive shaft [55.] The output shaft of the power head drives a first bevel gear [57*a*] which drives a second bevel gear [57*b*] to supply rotary power to the proximal end of the drive shaft, which is substantially perpendicular to the power head output shaft. In an alternative embodiment, gears [57*a*] and [57*b*] may also be a pinion and ring wheel set for speed reduction and increased torque. The distal end of the drive shaft includes a worm gear [58] which drives a complementary wheel [59.] The end of the bar includes a hose guide which in this embodiment comprises two fairleads [32] which are rods positioned transverse to the movement direction of incoming hose being wound upon the spool shaft. The distal end of the bar may further comprise a plurality or an array of holes so that the hose guide may be adjustably affixed to the distal end of the bar.

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A powered hose spooling device, comprising a power head housing a motor, said power head further comprising a handle and an output shaft, a backing plate attached to said power head, said backing plate further comprising a bar section having an aperture through which a hose guide is adjustably affixed to said bar section, a spool shaft perpendicular to and passing through a spool end wall disc, a rod parallel to said spool shaft and attached to said end wall disc for orbital rotation around said spool shaft, said rod axially parallel to and radially spaced apart from said spool shaft, and a power transmission operably coupled between said power head and said spool shaft, with said power transmission further comprising an epicyclic transmission.

2. The powered hose spooling device of claim 1, wherein said power transmission further comprises a drive train component selected from the set of components consisting of: a sprocket, a chain, a gear, an involute toothed gear, a bevel gear, a helical gear, a worm gear, a hypoid gear, a pinion gear, a ring wheel, and a helical gear.

3. The powered hose spooling device of claim 1, wherein said spool shaft passes through a component selected from the set of components consisting of: a split hub, a keyless locking bushing, a ball bearing, and a needle bearing.

4. The powered hose spooling device of claim 1, wherein said motor is a motor selected from the set of motors consisting of: an electric AC motor, an electric DC motor, a petroleum fuel engine, a 2-stroke motor, a 4-stroke motor, a radial engine, a hydraulic motor, a pneumatic motor, and an external rotor motor.

5. The powered hose spooling device of claim 1, wherein said backing plate further comprises a laterally stabilizing surface for hose accumulated upon said spool shaft.

6. The powered hose spooling device of claim 1, further comprising at least two fairleads affixed to a distal end of said bar section.

7. The powered hose spooling device of claim 1, wherein said spool end wall disc is coupled to said spool shaft for rotation therewith.

8. A powered hose spooling device, comprising a power head housing a motor, said power head further comprising a handle and an output shaft, a backing plate attached to said power head, said backing plate further comprising a bar section having an aperture through which a hose guide is adjustably affixed to said bar section, a spool shaft perpendicular to and passing through a spool end wall disc, a rod parallel to said spool shaft and attached to said end wall disc for orbital rotation around said spool shaft, said rod axially parallel to and radially spaced apart from said spool shaft, a worm gear and at least one bevel gear, and a power transmission operably coupled between said power head and said spool shaft.

9. The powered hose spooling device of claim 8, further comprising an epicyclic transmission.

10. The powered hose spooling device of claim 9, wherein said epicyclic transmission further comprises a sun gear engaged to a plurality of planetary gears whose center shafts are affixed to a differential arm so that said differential arm drives an output shaft of said epicyclic transmission.

11. The powered hose spooling device of claim 9, wherein a planetary gear of said epicyclic transmission is coupled to a shaft, with said shaft received in a bearing, with said bearing mounted in a differential arm of said epicyclic transmission.

12. The powered hose spooling device of claim 9, wherein a planetary gear of said epicyclic transmission includes a hub, with said hub further comprising a bearing, and a differential arm of said epicyclic transmission further comprises a shaft stub received into said differential arm.

13. The powered hose spooling device of claim 9, wherein a differential arm of said epicyclic transmission further comprises a shaft stub received into said differential arm, and wherein a planetary gear of said epicyclic transmission further comprises a bearing riding on said shaft stub.

14. The powered hose spooling device of claim 8, wherein said backing plate is comprised by a power train case attached to said power head, said power train case further comprising a perimeter wall, and with said powered hose spooling device further comprising a removable cover plate having a perimeter conforming to said of the perimeter wall of said power train case.

15. The powered hose spooling device of claim 8, wherein said spool end wall disc is coupled to said spool shaft for rotation therewith.

* * * * *